US011851231B2

(12) United States Patent
Bahr

(10) Patent No.: US 11,851,231 B2
(45) Date of Patent: Dec. 26, 2023

(54) BAG HOOK FOR A HINGED TOTE

(71) Applicant: ORBIS Corporation, Oconomowoc, WI (US)

(72) Inventor: Taylor James Bahr, Jefferson, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 17/586,180

(22) Filed: Jan. 27, 2022

(65) Prior Publication Data

US 2022/0242603 A1 Aug. 4, 2022

Related U.S. Application Data

(60) Provisional application No. 63/145,619, filed on Feb. 4, 2021.

(51) Int. Cl.
*B65B 67/12* (2006.01)
*A47B 77/18* (2006.01)

(52) U.S. Cl.
CPC ..... *B65B 67/1233* (2013.01); *A47B 77/18* (2013.01); *B65B 67/1255* (2013.01)

(58) Field of Classification Search
CPC .. B65B 67/1233; B65B 67/1255; A47B 77/18
See application file for complete search history.

(56) References Cited

U.S. PATENT DOCUMENTS 2,153,122 A * 4/1939 Powell ..... B65D 45/18 229/5.7
3,035,860 A * 5/1962 Bradner ..... B65D 55/04 292/258
3,130,853 A * 4/1964 Colthurst ..... B65F 1/06 220/495.08
3,757,990 A * 9/1973 Buth ..... B44D 3/126 248/101
3,825,150 A 7/1974 Taylor
4,349,121 A 9/1982 Lafferty
4,466,541 A 8/1984 Tabler et al.
5,353,948 A 10/1994 Lanoue et al.
5,380,081 A * 1/1995 Vogt ..... B65F 1/067 312/212
5,474,200 A 12/1995 Nicholson
5,881,901 A 3/1999 Hampton
6,024,223 A 2/2000 Ritter
6,592,025 B2 7/2003 Bazany et al.
6,916,986 B1 * 7/2005 Herzog ..... H02G 3/0418 52/287.1

(Continued)

FOREIGN PATENT DOCUMENTS

GB 2192666 A * 1/1988 ..... B65D 21/062
GB 2553841 A * 3/2018 ..... B65F 1/06

*Primary Examiner* — Kimberly T Wood
(74) *Attorney, Agent, or Firm* — GREENSFELDER, HEMKER & GALE, P.C.; Richard C. Himelhoch

(57) ABSTRACT

A clip-on bag hook for a hinged tote is provided. The bag hook includes a support portion, a hoop extending from a first end of the support portion and a hook extending from a second end of the support portion. A rib also extends from the second end of the support portion. A plurality of bag hooks can be clipped onto the hinge components of the tote. The bag hooks are preferably formed from an extruded plastic bar.

13 Claims, 9 Drawing Sheets

(56) References Cited

U.S. PATENT DOCUMENTS

| | | | | |
|---|---|---|---|---|
| 7,841,487 | B2 | 11/2010 | Miller et al. | |
| 7,987,578 | B2 | 8/2011 | Miller et al. | |
| 8,066,143 | B2 | 11/2011 | Baltz et al. | |
| 8,448,805 | B2 | 5/2013 | Hassell et al. | |
| 8,752,727 | B2 | 6/2014 | Niemann | |
| 10,351,296 | B2 | 7/2019 | Birchmeier | |
| 10,377,535 | B2 | 8/2019 | Sommer | |
| 10,689,190 | B2 * | 6/2020 | Granger | B65F 1/06 |
| 2005/0103797 | A1 | 5/2005 | Rader et al. | |
| 2005/0172452 | A1 * | 8/2005 | Koessler | E05D 9/005 16/267 |
| 2008/0006638 | A1 | 1/2008 | Yang et al. | |
| 2008/0191103 | A1 * | 8/2008 | Thurgar | B65F 1/06 248/101 |
| 2009/0050628 | A1 | 2/2009 | Sullivan | |
| 2013/0259405 | A1 * | 10/2013 | Jack | B65B 67/1255 248/101 |
| 2015/0257553 | A1 * | 9/2015 | Mackay | A47G 1/164 16/232 |
| 2015/0284152 | A1 | 10/2015 | Sommer | |
| 2016/0059917 | A1 * | 3/2016 | Hudson, Jr. | B62H 3/06 248/278.1 |
| 2020/0087060 | A1 * | 3/2020 | Granger | B65F 1/0006 |
| 2022/0234777 | A1 * | 7/2022 | Thistle | B65B 67/1233 |

* cited by examiner

BAG HOOK FOR A HINGED TOTE

CROSS-REFERENCE TO RELATED APPLICATIONS

The present invention claims priority to and the benefit of U.S. Provisional Patent Application No. 63/145,619 filed Feb. 4, 2021, the contents of which are incorporated herein by reference and made a part hereof.

FEDERALLY SPONSORED RESEARCH OR DEVELOPMENT

N/A

FIELD OF THE INVENTION

The present invention generally relates to clip-on bag hooks for use on a tote, and more particularly to an extruded plastic clip-on bag hook having a support portion, a hoop and a hook portion.

DESCRIPTION OF THE PRIOR ART

Known totes do not include any structures for keeping a bag open to facilitate loading of product into the bag before placing the bag in the tote. Instead, the bag is just loosely folded over the tote.

The present invention provides a clip-on bag hook that can be quickly and easily installed on a tote or other similar container to facilitate loading of product.

SUMMARY OF THE INVENTION

The present invention is directed to a bag hook for a hinged tote, a system including a tote and a plurality of clip-on bag hooks and method for installing bag hooks on the tote. The bag hooks enable a grocery bag, or other similar bag to remain open during loading of product into the bag and tote.

In accordance with one aspect of the invention, a clip-on bag hook is provided. The bag hook comprises a first planar portion having a first end and a second end, and a generally J-shaped hoop portion extending downward from the first end of the first planar portion. The bag hook also includes a hook portion extending upward from the second end of the first planar portion.

The bag hook also includes a rib extending downward from the first planar portion. The rib can extend downward from the second end of the first planar portion. The hook portion can be a second planar portion that extends at an angle with respect to the first planar portion.

The bag hook can be formed from plastic, or some other similar or suitable material. Preferably, the bag hook is formed from an extruded bar of plastic. This avoids the costs associated with forming the bag hooks from injection molding.

In accordance with another aspect of the invention, a bag hook hinged tote system is provided. The system comprises a tote having a bottom wall, a first side wall, and a second side wall opposing the first side wall. The tote also includes two opposing end walls and a first top wall connected to a top edge of the first side wall by a first hinge. The system further includes a first plurality of bag hooks clipped to the first hinge of the first side wall of the tote.

The system can also include a second top wall connected to a top edge of the second side wall by a second hinge. A second plurality of bag hooks can be clipped to the second hinge.

The bag hooks of the system can have a first planar portion having a first end and a second end, a generally J-shaped hoop portion extending downward from the first end of the first planar portion and a hook portion extending upward from the second end of the first planar portion. The bag hooks can also include a rib extending downward from the first planar portion. The rib can extend downward from the second end of the first planar portion.

The hook portion can be a second planar portion. Additionally, the hook portion can extend at an angle with respect to the first planar portion.

Both the tote and the bag hooks can be plastic. Other materials (e.g., metal) can be used for various components of the system (e.g., the hinge).

In accordance with yet another aspect of the invention, a method of installing a bag hook on a tote is provided. The method comprises providing a tote having a base, a first side wall extending upward from a first side of the base and a second side wall extending upward from a second side of the base opposing the first side of the base, a first top wall portion connected to an upper edge of the first side wall by a first hinge having a plurality of openings, and second top wall portion connected to an upper edge of the second side wall by a second hinge having a plurality of openings. The method also includes providing a plurality of bag hooks having a support, a hoop connected to a first end of the support, a rib connected to a second end of the support and a hook connected to the second end of the support. The method further includes inserting a rib of a first one of the plurality of bag hooks proximate a first one of the plurality of openings of the first hinge and pushing the first one of the plurality of bag hooks until the hoop snaps over the first hinge.

The method can also include inserting a rib of a second one of the plurality of bag hooks proximate a second one of the plurality of openings of the first hinge and pushing the second one of the plurality of bag hooks until the hoop snaps over the first hinge. Similarly, the method can further include inserting a rib of a third one of the plurality of bag hooks proximate a first one of the plurality of openings of the second hinge and pushing the third one of the plurality of bag hooks until the hoop snaps over the second hinge, as well as inserting a rib of a fourth one of the plurality of bag hooks proximate a second one of the plurality of openings of the second hinge, and pushing the fourth one of the plurality of bag hooks until the hoop snaps over the second hinge.

Other features and advantages of the invention will be apparent from the following specification taken in conjunction with the following Figures.

BRIEF DESCRIPTION OF THE DRAWINGS

To understand the present invention, it will now be described by way of example, with reference to the accompanying drawings in which.

DETAILED DESCRIPTION

Figure 1:
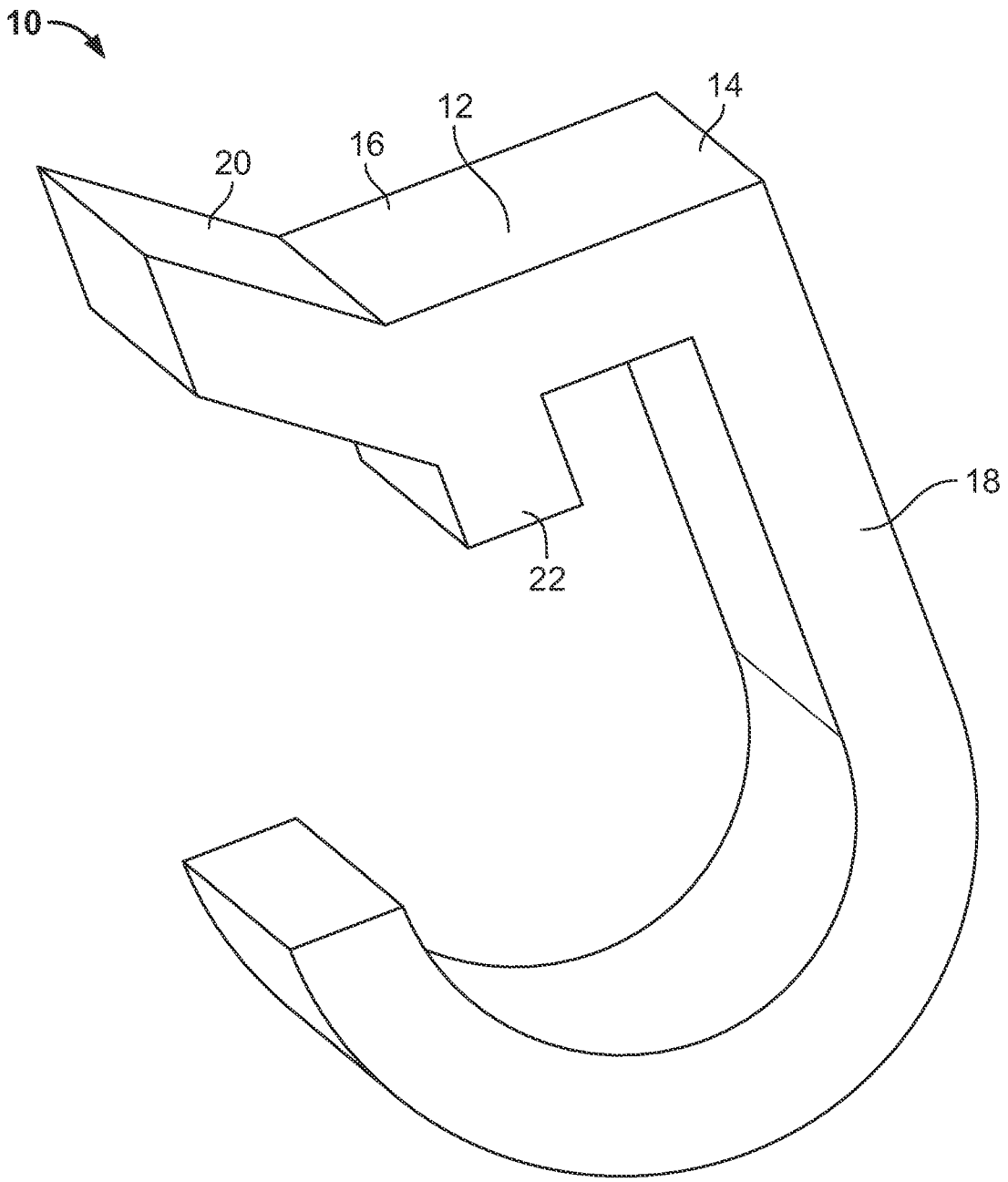
FIG. 1 is a perspective view of a bag hook in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Totes or similar containers do not include structure for keeping bags (e.g., grocery bags) open when loading certain types of products into the tote. The present invention provides hooks that can be clipped onto the tote. The handles of the bags can loop around the hooks to keep the bags open to assist in loading.

Figure 2:
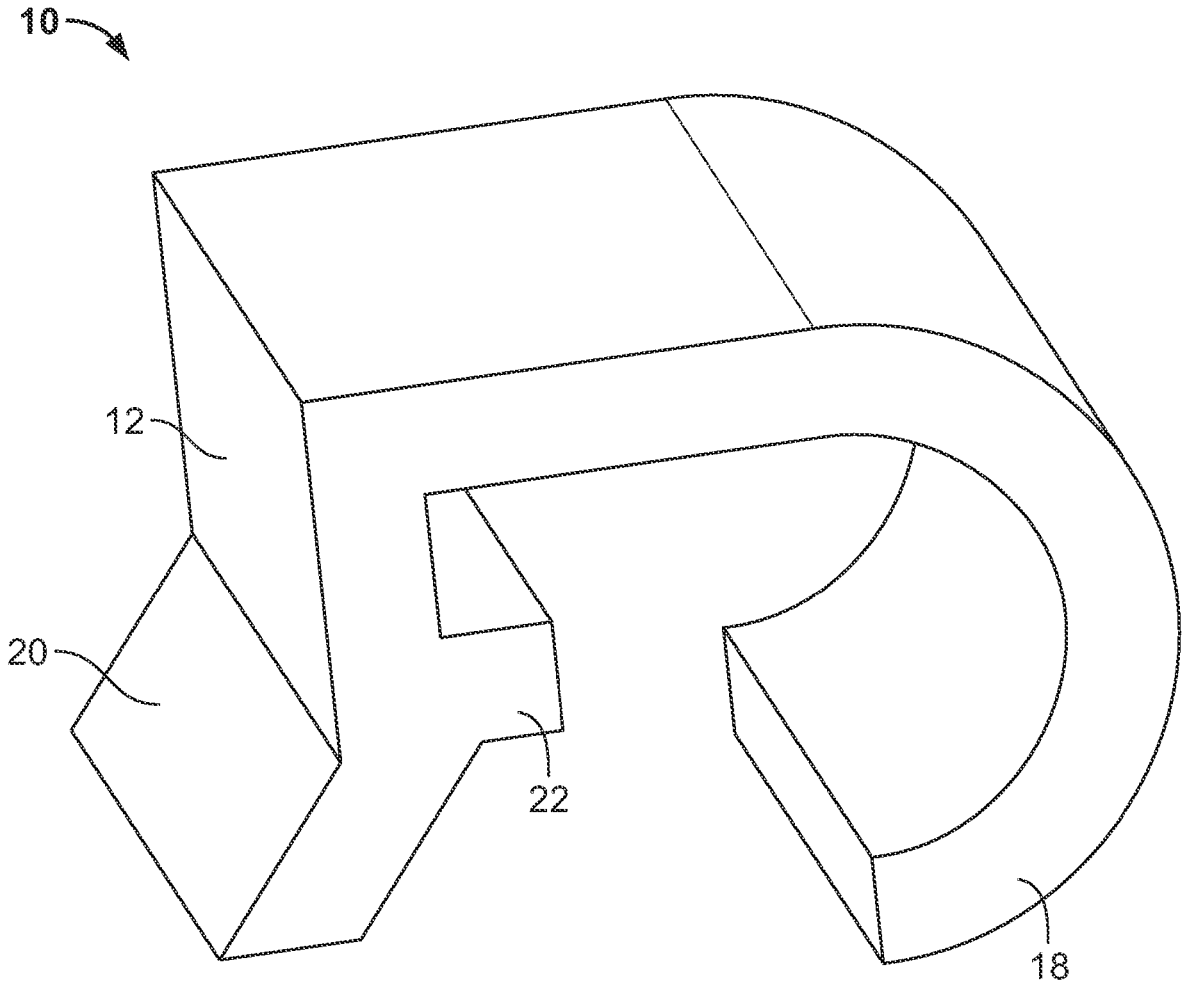
FIG. 2 is another perspective view of the bag hook of FIG. 1.

A clip-on bag hook 10 that can be utilized with a tote in the manner described is shown in FIGS. 1 and 2. The bag hook includes a generally planar support portion 12 having a first end 14 and a second end 16. A generally J-shaped hoop portion 18 extends downward from the first end 14 of the planar support portion 12. A hook portion 20 extends upward at an angle from the second end 16 of the planar support portion 12. The hook portion 20 is also shown as being generally planar. A rib 22 extends downward from the second end 16 of the planar support portion 12. [As set forth herein, directional terms such as downward etc. are used with respect to the positioning of elements as shown in one or more of the Figures and are not meant to limit the invention to being in such positions.]

The bag hook 10 is formed from plastic or other similar or suitable materials. Preferably, the bag hooks are extruded from a bar of plastic to eliminate the costs associated with forming the hooks by injection molding. The plastic is rigid, but has enough flexibility to enable the hooks 10 to snap onto the tote.

Installing a bag hook 10 on a tote is illustrated in FIGS. 3-6. A tote 24 includes a base, a first side wall 26, an opposing second side wall 28, a first end wall 30 and an opposing second end wall 32. The tote 24 also includes a first top panel or portion 34 that is hingedly connected to a top edge of the first side wall 26, and a second top panel or portion 36 that is hingedly connected to a top edge of the second side wall 28.

Figure 5:
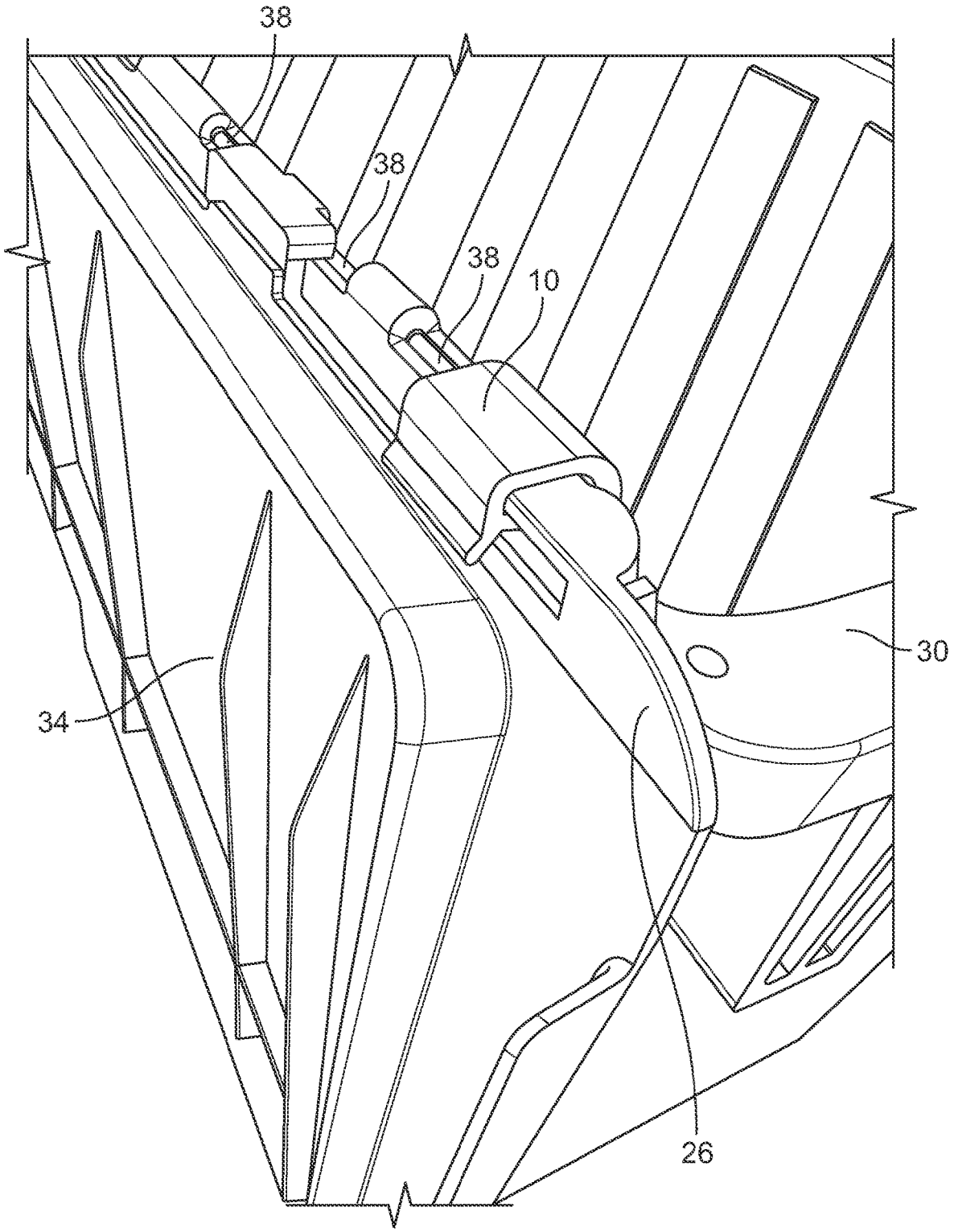
FIG. 5 is a perspective view of a bag hook installed on a tote.
Figure 6:
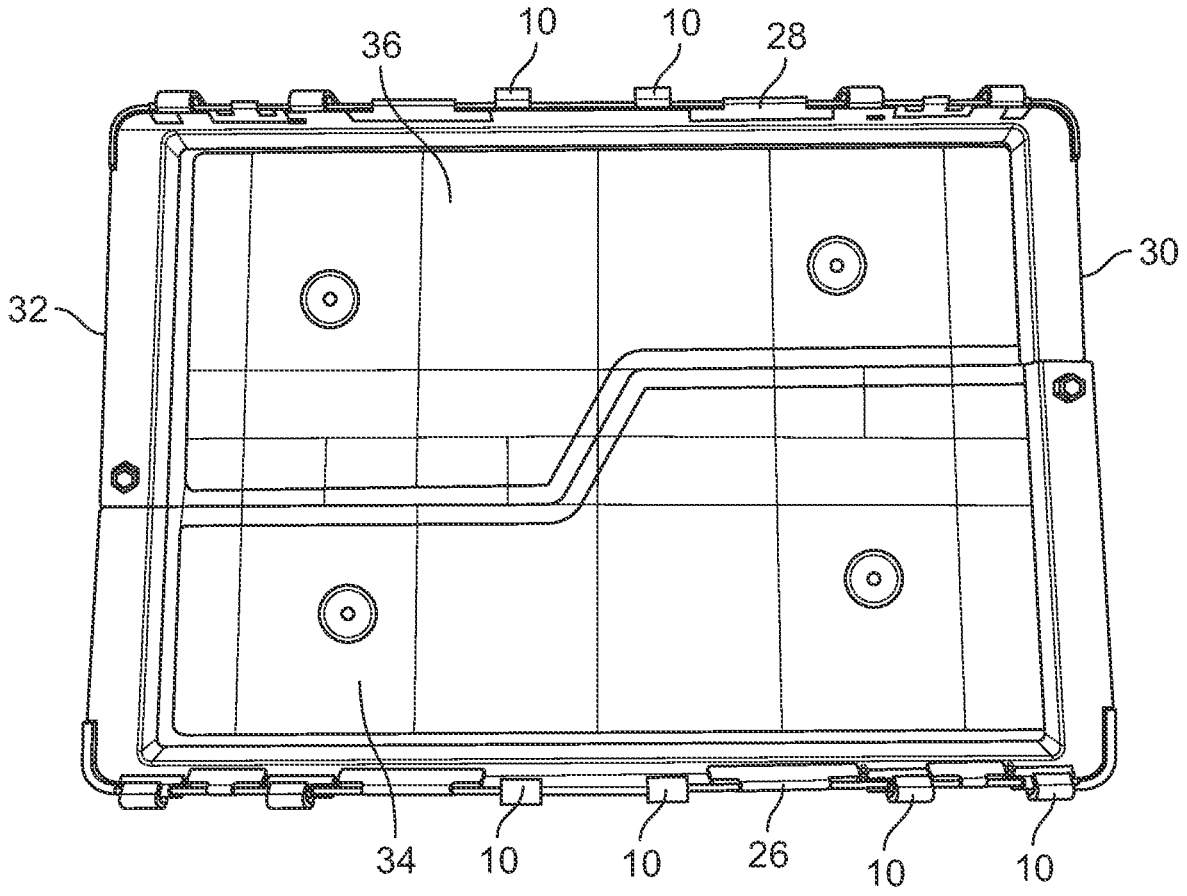
FIG. 6 is a perspective view of a tote with a plurality of installed bag hooks.

The tote 24 is predominately formed from plastic. However, in some instances, part of the hinge structures on the tote 24 can include a metal bar or rod that is inserted into hinge components in the side walls 26, 28 and top panels 34, 36. As illustrated in FIG. 5, the metal bar is visible via openings 38 (i.e., spaced gaps) between the hinge components.

Figure 3:
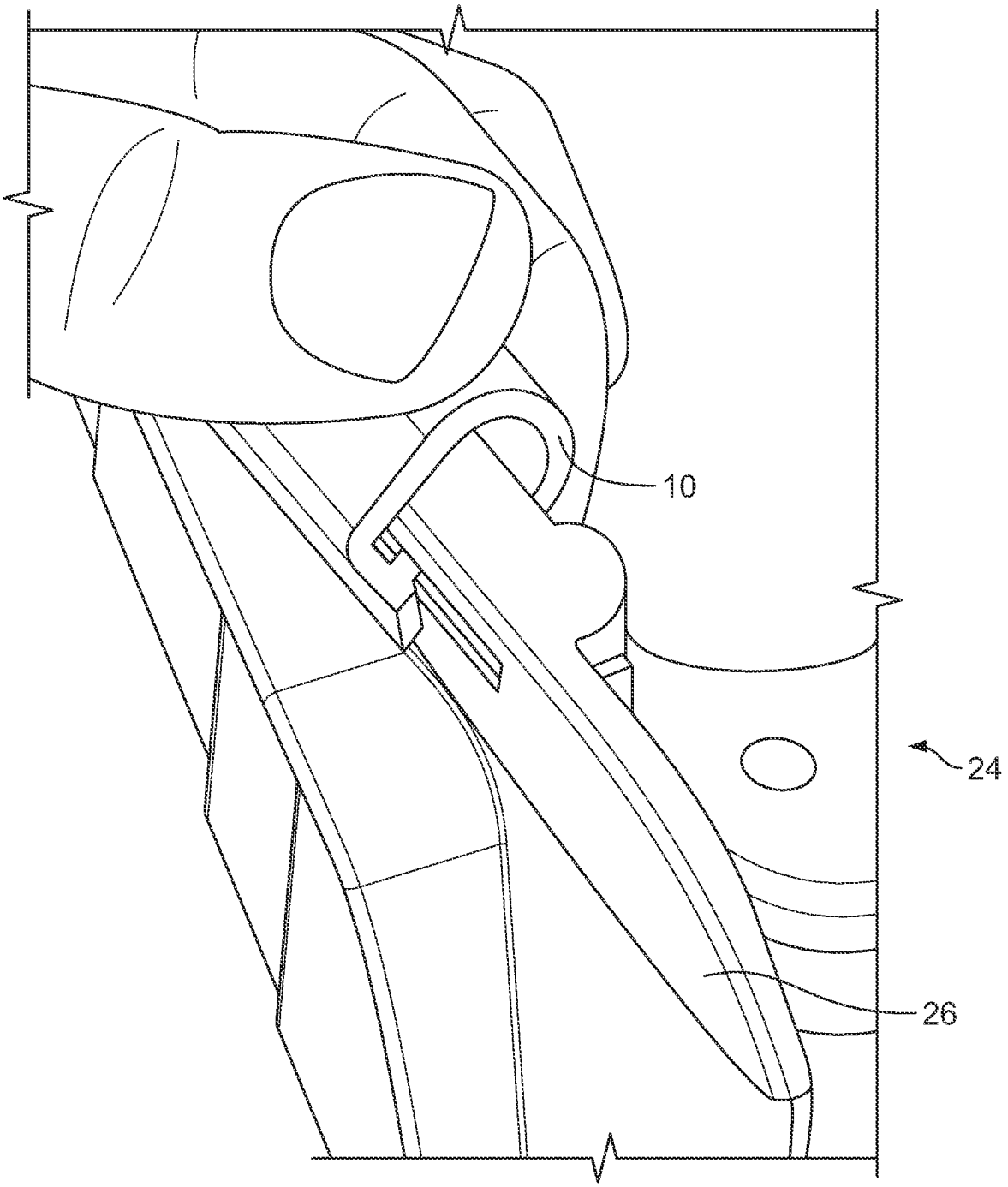
FIG. 3 is a perspective view of a bag hook being installed on a tote.
Figure 4:
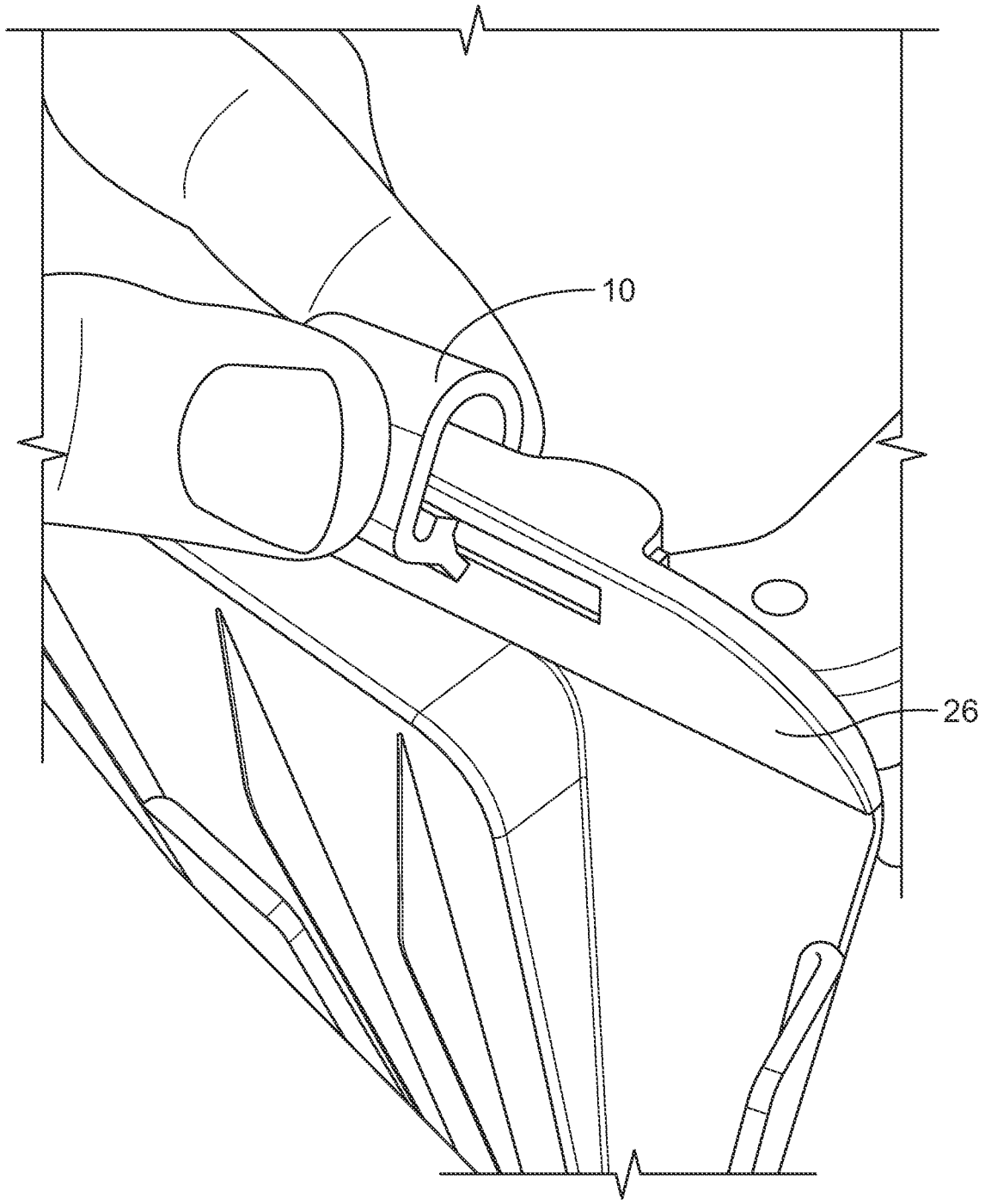
FIG. 4 is a perspective view of a bag hook being installed on a tote.

To connect a bag hook 10 to the tote 24, the rib 22 of the bag hook 10 is positioned as close as possible to one of the openings 38 (see FIGS. 3 and 5). The hoop 18 of the bag hook 10 is then pushed down over the hinge (see FIG. 4). The bag hook 10 will then snap into place (see FIG. 5). In this regard, the plastic of the bag hook is chosen to be generally rigid, but to have some flexibility. If necessary, the bag hook 10 can be removed by pulling up on the hoop 18. In the example shown, six bag hooks 10 are connected to each side of the tote 24.

The bag hooks can be made in various sizes and thicknesses depending on the size or type of tote they are to be used on. They can also be made in various colors which can be used as an indicator of the size of the bag hook.

Figure 7:
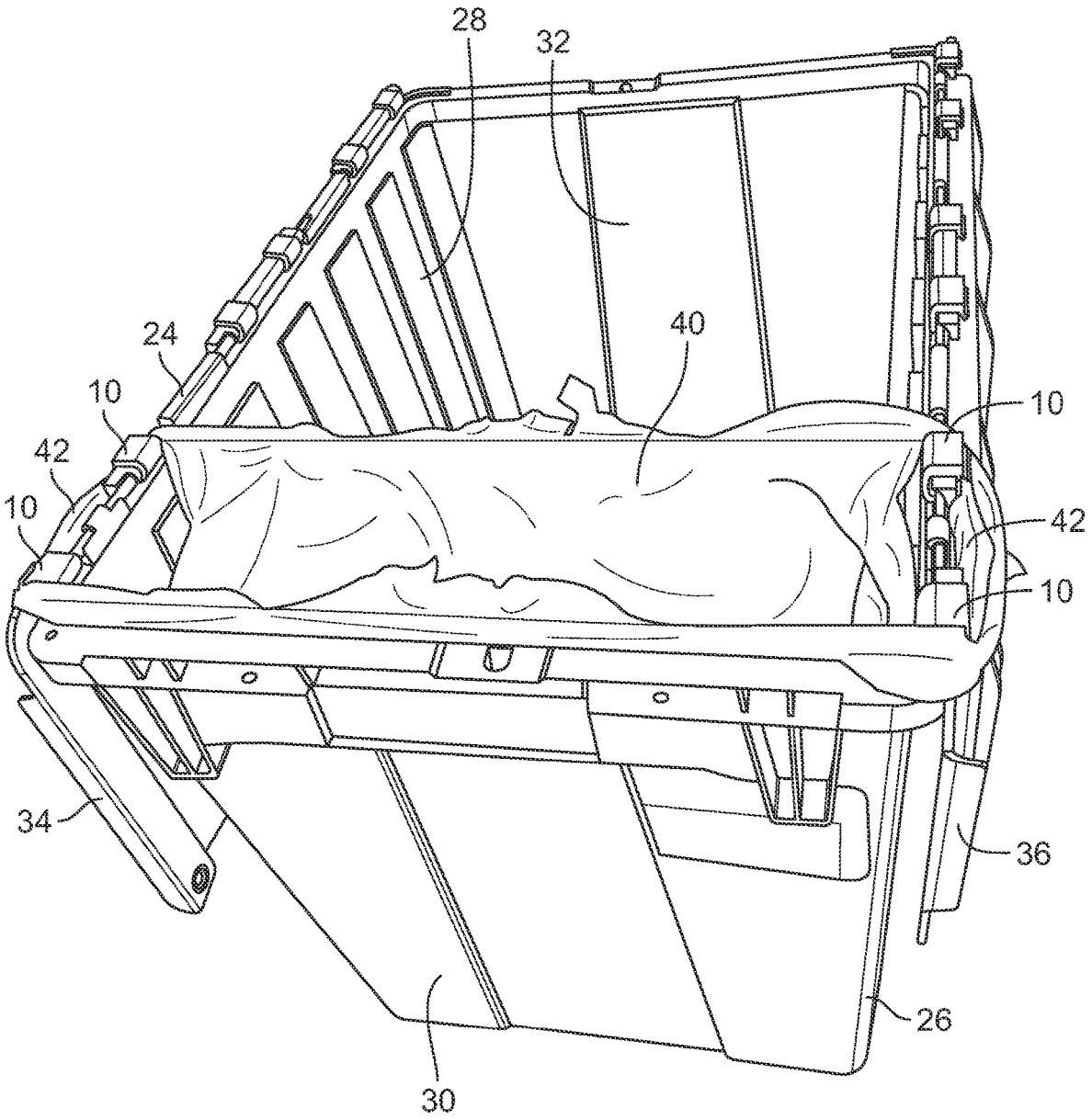
FIG. 7 is a perspective view of a first end of a tote with a plurality of installed bag hooks supporting a bag in an open position.
Figure 8:
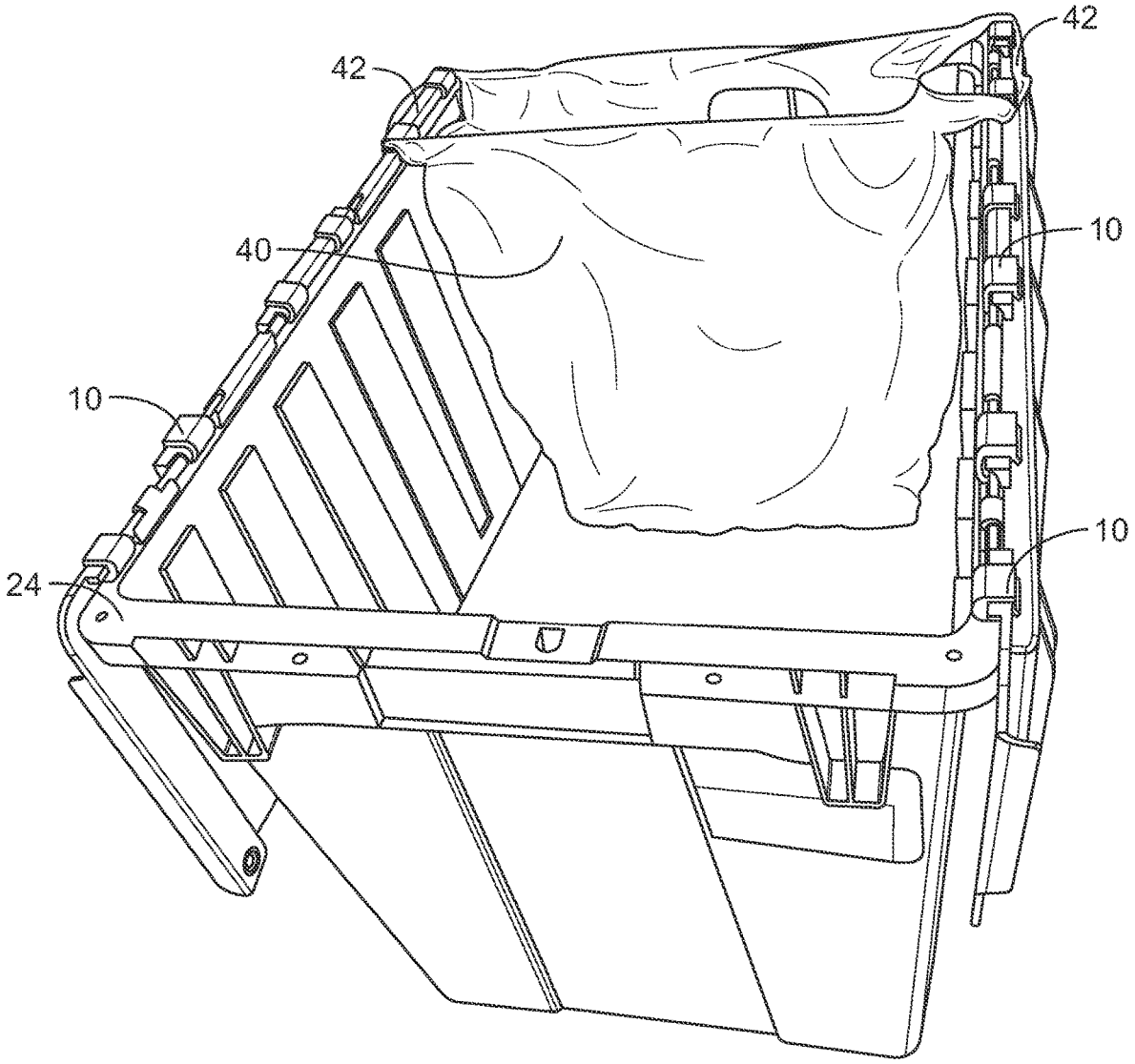
FIG. 8 is a perspective view of a second end of the tote of FIG. 7 with a plurality of installed bag hooks supporting a bag in an open position; and, FIG. 9 is an enlarged perspective view of a portion of the tote, bag hooks and open bag of FIG. 7.
Figure 9:
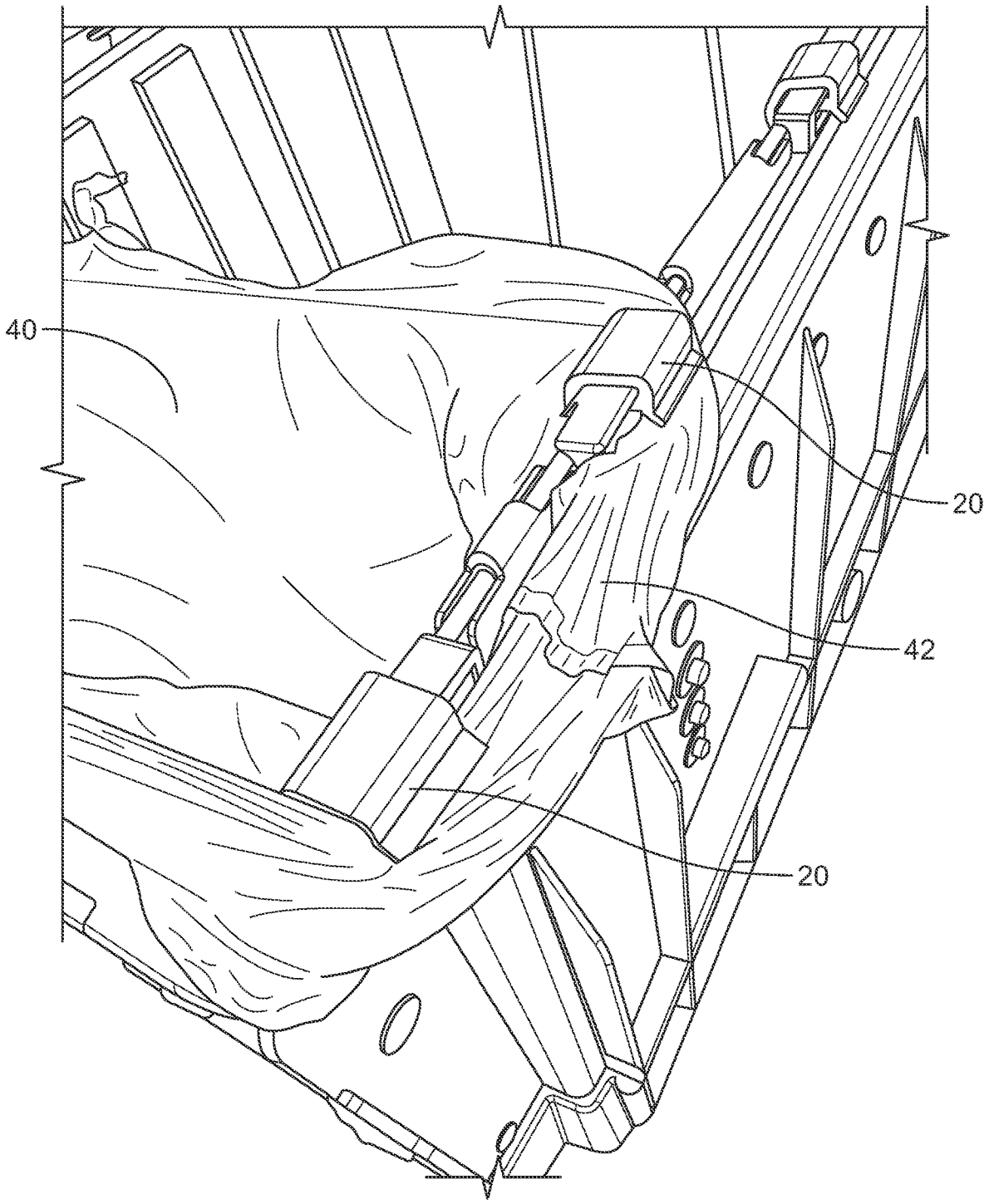

FIGS. 7-9 show a first bag 40 held open in a tote 24 using two sets of bag hooks 10 (two for each handle 42 of the bag 40). Each handle 42 of the bag is wrapped around the hook portions 20 of the bag hooks 10 (as more clearly shown in FIG. 9). The bag hooks 10 are spaced apart a sufficient distance in order to hold the bag open a desired amount.

It is apparent from FIGS. 7-9 that additional bags 40 can be supported in the tote 24 in a similar manner. Accordingly, a second bag 40 and a third bag 40 could be held open in the tote 24.

Additionally, larger bags can be placed in the tote 24, utilizing more of the bag hooks 10. That is, the handle of a larger bag could span more than two bag hooks 10 on each side of the tote 24.

Many modifications and variations of the present invention are possible in light of the above teachings. It is, therefore, to be understood within the scope of the appended claims the invention may be protected otherwise than as specifically described.

I claim:

1. A bag hook hinged tote system comprising:

a tote having a bottom wall, a first side wall, and a second side wall opposing the first side wall;

a first top wall connected to a top edge of the first side wall by a first hinge; and, a first plurality of bag hooks clipped to the first hinge; and, a second top wall connected to a top edge of the second side wall by a second hinge; and, a second plurality of bag hooks clipped to the second hinge.

2. The system of claim 1 wherein each of the first plurality of bag hooks and each of the second plurality of bag hooks comprise:

a first planar portion having a first end and a second end;

a generally J-shaped hoop portion extending downward from the first end of the first planar portion; and, a hook portion extending upward from the second end of the first planar portion.

3. The system of claim 2 wherein each of the first plurality of bag hooks and each of the second plurality of bag hooks comprise:

a rib extending downward from the first planar portion.

4. The system of claim 3 wherein the rib extends downward from the second end of the first planar portion.

5. The system of claim 4 wherein the hook portion is a second planar portion and extends at an angle with respect to the first planar portion.

6. The system of claim 1 wherein each of the first plurality of bag hooks is plastic.

7. The system of claim 1 wherein each of the first plurality of bag hooks is formed from an extruded plastic.

8. The system of claim 1 wherein the tote is plastic.

9. The system of claim 1 wherein the first plurality of bag hooks includes six bag hooks.

10. A method of installing a bag hook on a tote comprising:

providing a tote having a base, a first side wall extending upward from a first side of the base and a second side wall extending upward from a second side of the base opposing the first side of the base, a first top wall portion connected to an upper edge of the first side wall by a first hinge having a plurality of openings, and second top wall portion connected to an upper edge of the second side wall by a second hinge having a plurality of openings;

providing a plurality of bag hooks having a support, a hoop connected to a first end of the support, a rib connected to a second end of the support and a hook connected to the second end of the support;

inserting a rib of a first one of the plurality of bag hooks proximate a first one of the plurality of openings of the first hinge; and, pushing the first one of the plurality of bag hooks until the hoop snaps over the first hinge.

11. The method of claim 10 further comprising:

inserting a rib of a second one of the plurality of bag hooks proximate a second one of the plurality of openings of the first hinge; and, pushing the second one of the plurality of bag hooks until the hoop snaps over the first hinge.

12. The method of claim 11 further comprising:

inserting a rib of a third one of the plurality of bag hooks proximate a first one of the plurality of openings of the second hinge; and, pushing the third one of the plurality of bag hooks until the hoop snaps over the second hinge.

13. The method of claim 12 further comprising:

inserting a rib of a fourth one of the plurality bag hooks proximate a second one of the plurality of openings of the second hinge; and, pushing the fourth one of the plurality of bag hooks until the hoop snaps over the second hinge.

* * * * *